US005288067A

United States Patent [19]

Stock

[11] Patent Number: 5,288,067

[45] Date of Patent: Feb. 22, 1994

[54] METHOD AND APPARATUS FOR CONVEYING AN IMBRICATED STREAM OF SHEETS TO A SHEET PROCESSING MACHINE

[75] Inventor: Ernst Stock, Offenbach am Main, Fed. Rep. of Germany

[73] Assignee: MAN Roland Druckmaschinen AG, Fed. Rep. of Germany

[21] Appl. No.: 14,794

[22] Filed: Feb. 8, 1993

[30] Foreign Application Priority Data

Feb. 7, 1992 [DE] Fed. Rep. of Germany ..... 4203511

[51] Int. Cl.[5] ..... B65H 5/00

[52] U.S. Cl. ..... 271/276; 271/237; 271/245; 271/265; 271/197; 271/216; 271/151; 198/689.1

[58] Field of Search ..... 271/245, 246, 236, 237, 271/258, 265, 276, 195, 196, 197, 216, 150, 151; 198/689.1; 414/794.9, 793.1

[56] References Cited

U.S. PATENT DOCUMENTS

| | | | |
|---|---|---|---|
| 4,651,984 | 3/1987 | Emrich | 271/237 |
| 4,696,465 | 9/1987 | Willi | 271/237 |
| 4,765,451 | 8/1988 | Labombarde | 271/216 |
| 5,022,644 | 6/1991 | Burge | 271/265 |
| 5,133,543 | 7/1992 | Eitel et al. | 271/276 |
| 5,160,132 | 11/1992 | Hanada | 271/265 |

*Primary Examiner*—H. Grant Skaggs
*Attorney, Agent, or Firm*—Leydig, Voit & Mayer

[57] ABSTRACT

A method and apparatus for adjusting the suction pressure drawn through a conveyor belt which conveys a stream of underlapping sheets to an alignment station where sheets are aligned prior to being fed to a sheet-processing machine. A source of high pressure is coupled to a low pressure suction chamber adjacent the alignment station when the final sheet in the stream reaches the alignment end. The high pressure source rapidly equalizes the pressure with the chamber, thus enabling easy lateral alignment of the final sheet in the stream which has no following underlapping sheets to otherwise block the suction pressure.

17 Claims, 2 Drawing Sheets

METHOD AND APPARATUS FOR CONVEYING AN IMBRICATED STREAM OF SHEETS TO A SHEET PROCESSING MACHINE

FIELD OF THE INVENTION

This invention relates generally to sheet-processing machines, and more particularly to a method and apparatus for conveying an imbricated stream of sheets to a sheet-processing machine.

BACKGROUND OF THE INVENTION

Ordinarily, sheets are initially fed to a sheet-processing machine, such as a printing press, in an imbricated (i.e., regularly overlapping or underlapping) relationship. In these systems, a continuous circulating conveyor belt system typically is utilized to feed the sheets forwardly until the foremost sheet in the stream is aligned on a front lay mark, followed by a procedure wherein the side edge of the sheet is laterally aligned, for example, on a side lay mark. Once the leading sheet is in proper alignment, or registration, that sheet is then removed to the processing machine, for example, a printing cylinder of a printing press, and the following sheet becomes the foremost sheet for subsequent alignment.

In order to keep the stream of sheets from sliding or otherwise moving out of arrangement on the conveyor belt system, suction pressure is drawn through regularly-spaced openings in the conveyor belt. However, in order to align the leading sheet, particularly during the lateral alignment step, the amount of suction pressure must be reduced on the leading sheet to permit unrestricted movement. Accordingly, a second, variable pressure is drawn through the apertures in the conveyor belt that are currently in the vicinity of the front lay mark, i.e., at the alignment end of the sheet-conveying system. To accomplish this result, two independent sources of suction are employed to create different suction pressures (below atmospheric pressure) in separate chambers ordinarily disposed beneath the conveyor belt. The first pressure chamber contains a fixed suction pressure and is generally disposed beneath the largest portion of the conveyor table, while the second, adjustable pressure chamber, is disposed beneath the conveyor table only at the alignment end.

Accordingly, during the forward and lateral alignment procedures, the amount of suction pressure is reduced in the second chamber (beneath the forward alignment region) so that the sheet can be aligned without damage due to excessive suction forces. In essence, during alignment the suction pressure on the leading sheet is sufficiently reduced to enable the leading sheet to slide so that the sheet can be aligned in a forward direction against the front lay or lays, and laterally aligned by a side-aligning apparatus.

At the alignment end, most of the suction holes above the adjustable pressure chamber are covered by the following underlapping sheet. As a result, the leading sheet receives suction pressure from only a fraction of these openings, that is, through only the foremost strip of openings not covered by the following sheet. Prior to alignment, the suction pressure in the adjustable chamber is therefore reduced to a level that enables the leading sheet to slide easily in this typical underlapping situation.

However, when the final sheet in the stream becomes the leading sheet, there are no underlapping sheets following. Consequently, the suction pressure on the final sheet (from the second chamber) is applied through a substantially greater number of openings than was the previous leading sheets. As a result, the final sheet can be exposed to substantially greater suction pressure because no following sheets are present to block some of the openings. Thus, the sheet cannot freely move or be easily aligned, especially in the lateral direction. This remains true even if the source of pressure is disconnected to the adjustable suction chamber because the sheet essentially seals all of the openings to the adjustable chamber thereby preventing the air pressure from equalizing rapidly enough.

OBJECTS AND SUMMARY OF THE INVENTION

Accordingly, it is an object of the present invention to provide an improved method and apparatus for supplying a stream of sheets to a sheet-processing machine in proper alignment.

Another object is to provide a method and apparatus as characterized above wherein the final sheet in a stream of sheets may be more reliably supplied to a sheet-processing machine in proper alignment.

A further object is to provide a method and apparatus of the above kind wherein the suction pressure on the final sheet in a stream of sheets is selectively reduced sufficiently to enable easy and reliable alignment of that sheet.

Yet another object is to provide a method and apparatus for supplying a stream of sheets to a sheet-processing machine in proper alignment that may be simply and inexpensively retro-fitted on existing suction type conveyor belt sheet-conveying systems.

Other objects and advantages will become apparent from the following detailed description when taken in conjunction with drawings, in which:

While the invention will be described in connection with the preferred embodiment, there is no intent to limit it to that embodiment. On the contrary, the intent is to cover all alternatives, modifications, and equivalents within the spirit and scope of the invention as defined by the appended claims.

DETAILED DESCRIPTION OF THE PREFERRED EMBODIMENT

Figure 1:
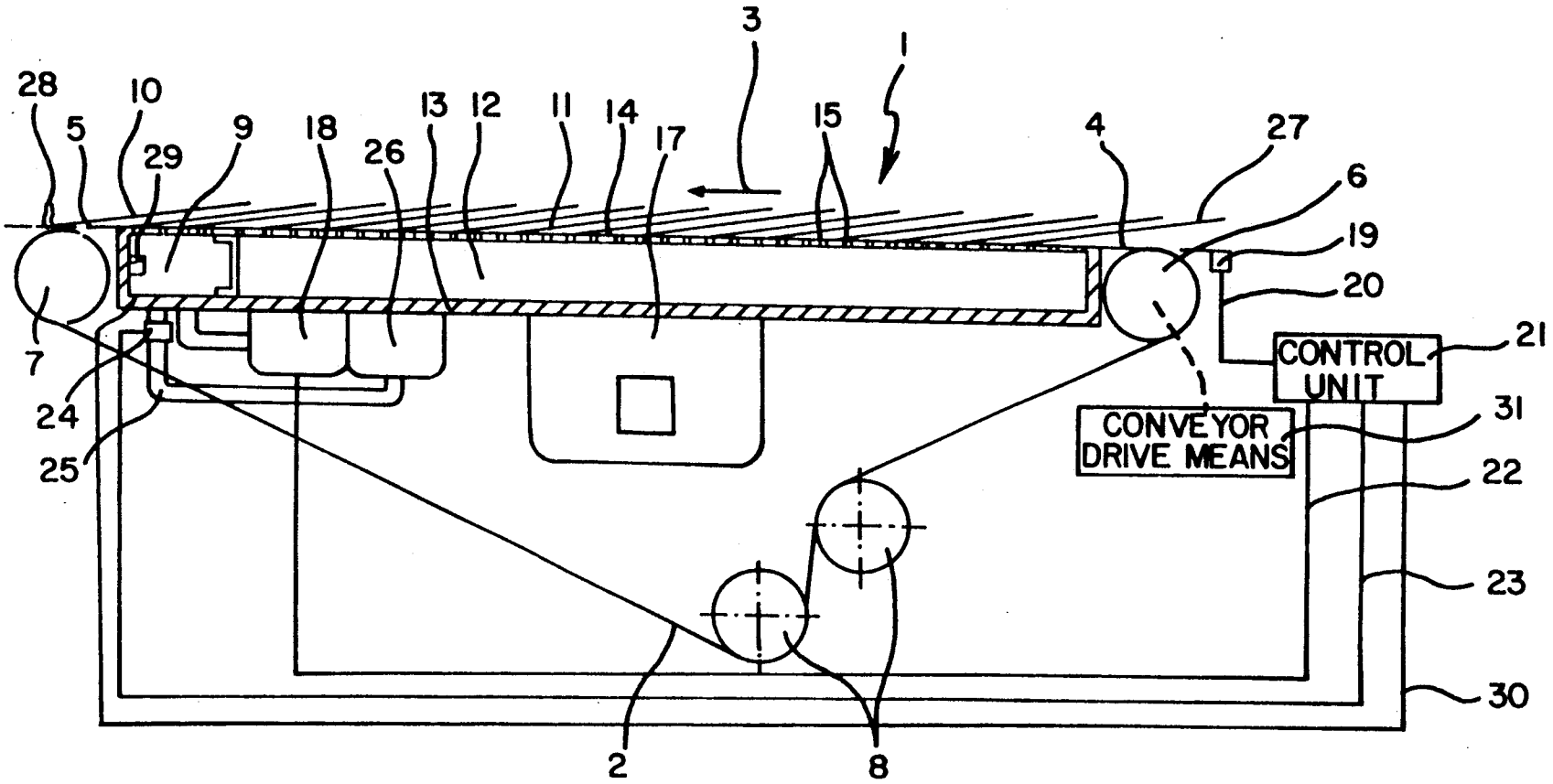
FIG. 1 is a side view of a sheet-conveying apparatus according to the invention.

Turning now to FIG. 1 of the drawings, there is shown a conveyor table 1 having an upper table surface 14 around which a conveyor belt or belts 2 is trained for movement in a direction represented by directional arrow 3, i.e., counter-clockwise in FIG. 1. A stream of sheets 11 is continually directed onto the conveyor belt 2 from a source end 4 in a known manner with each preceding sheet being in partially underlapping relationship to the preceding sheet as they proceed from the source end 4 toward an alignment end 5. Preferably, the conveyor belt 2 is trained around a pair of deflection rollers 6, 7 disposed at the source end 4 and alignment end 5, respectively. The conveyor belt 2 is kept taut by a pair of tension rollers 8 disposed beneath the conveyor table 1, which may have springs or other means for adjusting their positions to provide control of the amount of tension in the conveyor belt 2. Preferably, the deflection roller 6 disposed at the source end 4 is driven by a conveyor drive means 31 (such as a motor or a shaft connected to a drive of the sheet-processing machine) and therefore acts as the drive roller to move the entire conveyer belt system.

A suction box 13 extends beneath the entire length of the conveyor table 1 and comprises two separate chambers, specifically a main low pressure chamber 12 (i.e., a first chamber) and an adjustable pressure chamber 9 (i.e., a second chamber). As shown in FIG. 1, in the preferred embodiment the main low pressure chamber 12 extends from the source end 4 and is beneath a substantial portion of conveyor table 1, while the adjustable pressure chamber 9 is disposed only in the vicinity of the alignment end 5, immediately downstream of the main low pressure chamber 12.

Figure 2:
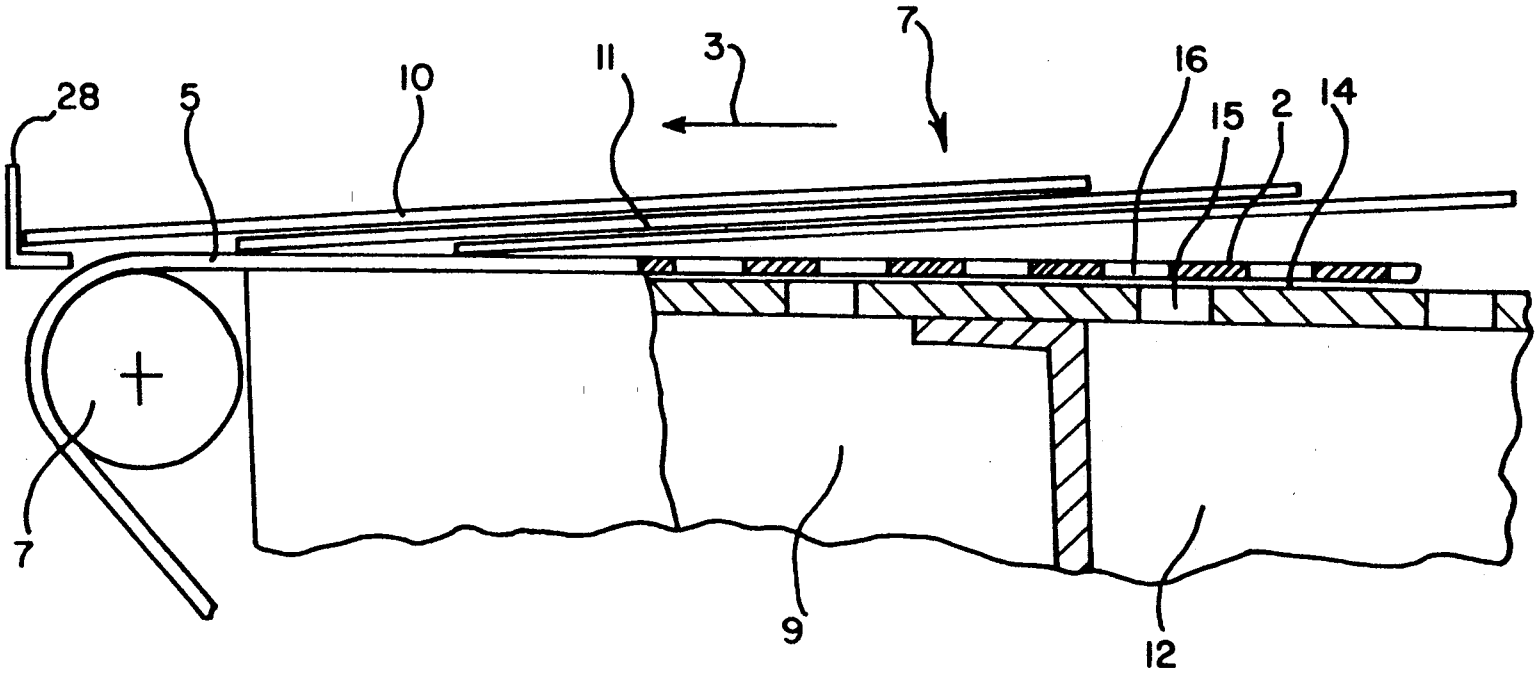
FIG. 2 is an enlarged vertical section of the alignment end of the sheet-conveying apparatus shown in FIG. 1.

As best shown in FIG. 2, the conveyor belt 2 is perforated with apertures 16 in an essentially uniform pattern. Similarly, the upper surface 14 of the conveyor table 1 includes a number of openings 15 which align with the belt apertures 16 to permit communication with the adjustable pressure chamber 9 and the main low pressure chamber 12. Preferably, the dimensions of the openings 15 and the perforation pattern of the apertures 16 are designed such that a substantial number of openings are always aligned as the conveyor belt 2 moves across the upper surface 14.

As shown in FIG. 1, a first suction source 17 produces a vacuum pressure in main low pressure chamber 12, creating suction through the conveyor table surface 14 (through openings 15) and conveyor belt 2 (through apertures 16) over the entire length of main low pressure chamber 12. The suction is thereby applied to the stream of sheets 11, which results in the stream of sheets 11 being drawn against conveyor belt 2 for conveyance without slippage in the direction represented by directional arrow 3. Similarly, sheets currently above the adjustable chamber 9, for example leading sheet 10, are influenced by the air pressure in the adjustable pressure chamber 9.

As the stream of sheets 11 is conveyed towards a forward abutment, i.e., a front lay mark 28 the level of pressure in the adjustable pressure chamber 9 usually is adjusted so that the leading sheet 10 can slide relatively easily during sheet alignment procedures, thereby enabling sheet alignment. As in the prior art systems, the suction pressure in the adjustable pressure chamber 9 usually is reduced prior to the lateral alignment procedure. Moreover, as best shown in FIG. 2, the amount of suction pressure on the leading sheet 10 is significantly blocked by the immediately following underlapping sheet in the stream 11, Which results in reduced suction pressure being applied to the leading sheet 10. As a result of such blockage of the suction pressure to the leading sheet, the pressure in the adjustable pressure chamber 9 may not have to be reduced significantly to accomplish alignment.

However, when the supply of sheets directed onto the conveyor belt 2 is exhausted or otherwise interrupted, a final sheet 27 exists in the stream of sheets 11 and eventually becomes the leading sheet. Since there no longer is an underlapping sheet to block a substantial portion of the air passages communicating with adjustable chamber 9, the suction pressure in adjustable chamber 9 is fully applied the sheet, impeding the ability to properly bring it into forward and lateral alignment.

In accordance with the invention, means are provided for sensing the final sheet in the stream of sheets directed onto the conveyor table and means responsive to the sensor means are provided for interrupting the communication of suction pressure to the second chamber and communicating a high pressure source to the second chamber for rapidly reducing the amount of suction pressure on the final sheet when the final sheet is the only sheet remaining on the conveyor table. To this end, in the illustrated embodiment, a sensor 19 is disposed at the source end 4 for detecting the final sheet 27 in the stream 11 as it is directed onto the table. The sensor 19, preferably an optoelectronic sensor, electrically signals this event through line 20 to a control unit 21. Because the sheets in the stream 11 are underlapped at regularly known intervals, and because the length of the conveyor table 1 is known, the exact number of sheets remaining in the stream at the time of the sensor signal is known. Thus, the time that the final sheet 27 will reach the alignment end 4 is known, either by simply counting down the remaining sheets as they are aligned or by timing the arrival of the final sheet 27 at the front lay 28 based on the linear speed of the conveyor belt 2. In the preferred embodiment, each aligned-and-removed sheet is counted after the sensor 19 signal has been received at the control unit 21. The final sheet 27 will reach the front lay mark 28 when the number of alignment-and-removal cycles counted equals the number of sheets that were on the conveyor table 1 at the time of final sheet detection minus one. Alternatively, it will be understood by one skilled in the art that other sensors could be utilized for detecting when only the final sheet 27 remains on the conveyor table 1 thereby eliminating the need for counting or timing means.

The control unit 21 is electrically connected via line 22 to the source of suction 18 that provides suction pressure to the adjustable pressure chamber 9, and also is electrically connected via line 23 to an electromagnetic valve 24 that, when opened, pneumatically connects adjustable chamber 9 to a source of high pressure 26 (an air pump or compressor) through a pressure conduit 25.

In keeping with the invention, at the time that the final sheet 27 is the only sheet remaining on the conveyor table 1, (and is therefore above the adjustable pressure chamber 9), the control unit 21 provides a first signal via line 22 disabling the second source of suction 18 and a second signal via line 23 to open the normally-closed electromagnetic valve 24. Alternatively, a single signal could be employed for both operations, however, it can be readily appreciated that providing separate signals allows for added system flexibility, for example, in order to compensate for physical delay times inherent in valves and suction pumps.

As a result of opening of the valve 24 along with the shutting down of source of suction 18, adjustable chamber 9 rapidly reaches the optimal pressure (preferably equalized atmospheric pressure). Thus, the final sheet 27 is able to be aligned, even though it directly covers a substantially larger number of air passages to the second chamber 9 than the preceding sheets. Because the source of high pressure 26 (which provides a pressure above atmospheric pressure) is utilized, the pressure in the adjustable chamber 9 increases more rapidly than it would by merely opening the valve 24 to atmosphere.

Nevertheless, other such atmospheric equalization systems could be used. For example, valve 24 could be arranged to open a port to atmosphere (not shown) rather than to a source of high pressure. In such case, the pressure in adjustable pressure chamber 9 could be equalized in sufficient time by opening the valve 24 to atmosphere and shutting down of the suction source 18 at an earlier, calculated time, taking into consideration the diameters of the respective air conduits, the dimensions of the adjustable chamber 9, and the amount of suction pressure initially in the adjustable chamber 9.

Alternatively, rather than having a continuously operating source of high pressure 26, the source could be intermittently activated only as needed. Nevertheless, employing a continuously operating source of high pressure 26 connected to the second chamber 9 through the normally closed electromagnetic valve 24 provides the most rapid, reliable, and easily controllable pressure equalization system.

In the preferred embodiment, the control unit 21 only opens valve 24 for a controlled period of time (for example one second) that ordinarily depends on the relative pressures provided by both the high pressure source 26 and the suction source 18, the diameter of conduit 25 and the dimensions of adjustable pressure box 9. Alternatively, a separate pressure sensor 29 can be employed that either directly (not shown) or by signalling the control unit 21 via line 30 results in the closure of valve 24 when atmospheric pressure is reached. In any case, regardless of how the exact amount of time is determined for the valve 24 to remain open before closing, the system rapidly increases the pressure in adjustable chamber 9 to approximately atmospheric pressure, but not above, since increasing it above atmospheric pressure would lift the sheet off of the table surface 14.

The control unit 21 can be suitably designed in a number of ways, preferably by incorporating it into a microprocessor-based system that additionally could control the other operations required for the alignment, forward conveyance, and the like. Alternatively, a simple control unit can be designed employing a counter, a timer and other digital logic circuitry.

As can be seen from the foregoing detailed description, a simple, inexpensive and reliable method and apparatus is provided for rapidly adjusting the amount of suction pressure on sheets being conveyed on a conveyor belt, to enable proper sheet alignment even when the sheet is the final sheet in a stream and has no underlapping sheets. Further, such system lends itself to simple and inexpensive modification of existing sheet-conveying apparatuses.

What is claimed is:

1. An apparatus for conveying an imbricated stream of sheets including a final sheet to an alignment station of a sheet process machine having front and side sheet alignment means comprising a conveyor table having a source end and an alignment end, a belt conveyor disposed for movement around said conveyor table, drive means for moving the belt conveyor and conveying said stream of sheets over the table from the source end to the alignment end, a suction box disposed below the conveyor table and communicating via suction openings in the table to the underside of the belt conveyor, the suction box including a first chamber located adjacent the source end and a second chamber disposed adjacent the alignment end, a first source of suction pressure coupled to the first chamber and communicating with the belt conveyor for retaining sheets on the belt conveyor at the source end, a second source of suction pressure coupled to the second chamber and communicating with the belt conveyor for retaining sheets on the belt conveyor at the alignment end, means for sensing the direction of the final sheet in the stream onto said conveyor table, and means responsive to said sensing means for interrupting communication of said second suction pressure source to said second, chamber and for communicating a high pressure source to said second chamber for rapidly reducing the amount of suction pressure on the final sheet when the final sheet is the only sheet remaining on the conveyor table.

2. The apparatus of claim 1 in which said high pressure source is communicated to said second chamber until said second chamber reaches atmospheric pressure.

3. The apparatus of claim 1 including a control unit, said sensing means being operable for communicating a signal to said control unit upon sensing the final sheet directed onto on said conveyor table, and said control unit is operable for communicating said high pressure source to said second chamber after a predetermined period of time.

4. The apparatus of claim 1 including a control unit, said sensing means being operable for communicating a signal to said control unit upon sensing the final sheet directed onto on said conveyor table, and said control unit is operable for communicating said high pressure source to said second chamber after a predetermined number of sheets have been aligned at said alignment station.

5. An apparatus for conveying a stream of sheets including a final sheet to a sheet-processing machine, comprising, in combination:

a conveyor table including a source end and an alignment end, the conveyor table having a plurality of openings;

a conveyor belt disposed around the conveyor table for supporting the stream of sheets for movement over the table, the conveyor belt including a plurality of apertures pneumatically communicating with some of the openings in the conveyor table;

drive means for circulating the conveyor belt around the conveyor table, thereby conveying the stream of sheets supported thereon over the table from the source end toward the alignment end;

a first chamber disposed beneath the conveyor table adjacent the source end, the openings in the conveyor table providing pneumatic communication with the first chamber;

a first source of suction pressure coupled to the first chamber for providing a suction pressure through the openings in the conveyor table and through the apertures in the conveyor belt thereby retaining sheets at the source end on the conveyor belt;

a second chamber disposed beneath the conveyor table adjacent the alignment end, the openings in the conveyor table providing pneumatic communication with the second chamber;

a second source of suction pressure coupled to the second chamber for providing a second suction pressure through the openings in the conveyor table and through the apertures in the conveyor belt, thereby retaining sheets on the conveyor belt at the alignment end;

means for selectively disabling the second source of suction;

a source of high pressure;

controllable valve means-for selectively coupling the source of high pressure to the second chamber upon receipt of a control signal;

sensing means for detecting the final sheet in the stream and providing a signal indicative thereof; and a control unit responsive to the signal from the sensing means for determining when the final sheet is the only sheet remaining on the conveyor table, the control unit being in communication with the means for disabling the second source of suction and the controllable valve means, wherein the control unit disables the second source of suction and controls the valve means to couple the source of high pressure to the second chamber thereby rapidly reducing the amount suction pressure on the final sheet when the final sheet is the only sheet remaining on the conveyor table.

6. The apparatus of claim 5 wherein the control unit couples the source of high pressure to the second chamber only until the air pressure in the second chamber is approximately equal to atmospheric pressure.

7. The apparatus of claim 6 including pressure sensing means for providing a signal to the control unit when the air pressure in the second chamber is approximately equal to atmospheric pressure.

8. The apparatus of claim 6 wherein the control unit couples the source of high pressure to the second chamber only for a predetermined period of time.

9. The apparatus of claim 5 wherein the sensing means is disposed at the source end of the feed table, and the control unit includes counter means for determining when the final sheet is the only sheet remaining on the conveyor table.

10. The apparatus of claim 5 wherein the sensing means comprises an optoelectronic sensor.

11. The apparatus of claim 5 wherein the source of high pressure continuously provides air pressure in excess of atmospheric pressure.

12. The apparatus of claim 5 wherein the valve means comprises an electromagnetically operated valve.

13. A method of conveying a stream of sheets arranged in an underlapping fashion, including a final sheet having no underlapping sheet, to a sheet-processing machine, the method comprising the steps of:

providing a first source of low pressure to create suction in a first chamber for pneumatically retaining the stream of sheets on a conveyor belt;

conveying the stream of sheets on the conveyor belt towards an alignment station;

providing a second source of low pressure to create suction in a second chamber for pneumatically retaining the stream of sheets on the conveyor belt at the alignment station;

reducing the pressure in the second chamber to reduce the pneumatic retention force of the foremost sheet on the conveyor belt at the alignment end;

aligning and removing the foremost sheet in the stream;

providing a source of high pressure;

determining when the final sheet is the only sheet remaining in the stream;

disabling the source of low pressure to the second chamber when the final sheet is the only sheet remaining of the stream;

connecting the source of high pressure to the second chamber when the final sheet is the only sheet remaining of the stream, thereby assisting in the reduction of the pneumatic retention force of the final sheet on the conveyor belt; and aligning and removing the final sheet in the stream.

14. The method of claim 13 wherein the step of determining when the final sheet is the only sheet remaining of the stream includes sensing the interruption of the stream of sheets, and counting down the number of sheets being aligned and removed from the number of sheets in the stream at the time interruption of the stream of sheets is sensed.

15. The method of claim 13 wherein the step of connecting the source of high pressure to the chamber includes operating an electromagnetic valve.

16. The method of claim 15 including the steps of detecting the level of air pressure in the second chamber, and opening said valve only until the pressure in the chamber becomes approximately equal to atmospheric pressure.

17. The method of claim 13 wherein the step of connecting the source of high pressure to the chamber includes operating an electromagnetic valve for a predetermined short period of time.

* * * * *